US009994941B2

(12) United States Patent
Takashima et al.

(10) Patent No.: US 9,994,941 B2
(45) Date of Patent: Jun. 12, 2018

(54) HIGH STRENGTH COLD ROLLED STEEL SHEET WITH HIGH YIELD RATIO AND METHOD FOR PRODUCING THE SAME

(71) Applicant: JFE STEEL CORPORATION, Chiyoda-ku, Tokyo (JP)

(72) Inventors: Katsutoshi Takashima, Fukuyama (JP); Yuki Toji, Kawasaki (JP); Kohei Hasegawa, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 774 days.

(21) Appl. No.: 14/363,171

(22) PCT Filed: Dec. 3, 2012

(86) PCT No.: PCT/JP2012/007720

§ 371 (c)(1),
(2) Date: Jun. 5, 2014

(87) PCT Pub. No.: WO2013/088666

PCT Pub. Date: Jun. 20, 2013

(65) Prior Publication Data

US 2014/0332119 A1 Nov. 13, 2014

(30) Foreign Application Priority Data

Dec. 12, 2011 (JP) ..... 2011-270933

(51) Int. Cl.

| | |
|---|---|
| ***C22C 38/02*** | (2006.01) |
| ***C22C 38/04*** | (2006.01) |
| ***C21D 8/02*** | (2006.01) |
| ***C21D 9/46*** | (2006.01) |
| ***C22C 38/34*** | (2006.01) |
| ***C22C 38/06*** | (2006.01) |
| ***C22C 38/58*** | (2006.01) |
| ***C22C 38/00*** | (2006.01) |
| ***C22C 38/12*** | (2006.01) |
| ***C22C 38/14*** | (2006.01) |
| ***C21D 8/04*** | (2006.01) |
| ***C22C 38/08*** | (2006.01) |
| ***C22C 38/16*** | (2006.01) |

(52) U.S. Cl.

CPC ..... *C22C 38/34* (2013.01); *C21D 8/0236* (2013.01); *C21D 8/0263* (2013.01); *C21D 8/0273* (2013.01); *C21D 8/0436* (2013.01); *C21D 9/46* (2013.01); *C22C 38/001* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/58* (2013.01); *C21D 2211/005* (2013.01); *C21D 2211/009* (2013.01)

(58) Field of Classification Search

CPC ..... C21D 2211/005; C21D 2211/009

See application file for complete search history.

(56) References Cited

U.S. PATENT DOCUMENTS

| | | | | |
|---|---|---|---|---|
| 8,784,578 | B2 | 7/2014 | Kawasaki | |
| 2012/0037282 | A1* | 2/2012 | Kawasaki | C21D 8/0205 148/533 |
| 2012/0279617 | A1 | 11/2012 | Kawasaki | |
| 2013/0048155 | A1 | 2/2013 | Kaneko | |

FOREIGN PATENT DOCUMENTS

| | | | |
|---|---|---|---|
| JP | 2688384 | | 12/1997 |
| JP | 3887235 | | 2/2007 |
| JP | 2007211280 | | 8/2007 |
| JP | 2008-156680 | A | 7/2008 |
| JP | 2008174776 | | 7/2008 |
| JP | 2009-174019 | A | 8/2009 |
| JP | 2009185355 | | 8/2009 |
| JP | 2009235441 | | 10/2009 |
| JP | 2010255097 | | 11/2010 |
| JP | 4662175 | | 3/2011 |
| JP | 4696870 | | 6/2011 |
| JP | 2011153368 | | 8/2011 |
| JP | 2011168876 | | 9/2011 |
| JP | 2011168878 | | 9/2011 |
| JP | 2011168879 | | 9/2011 |

(Continued)

OTHER PUBLICATIONS

William D. Callister, Jr., Materials Science and Engineering, an Introduction, Sixth ed., Ch. 10, Phase Transformations in Metals: Development of Microstructure and Alteration of Mechanical Properties, John Wiley & Sons, 2003, pp. 298-326.*

Korean Notice of Allowance dated Feb. 25, 2016 for Korean Application No. 10-2014-7017161 with translation.

Chinese Office Action and Search Report with partial translation for Application No. 201280061365.4, dated Sep. 2, 2016, 9 pages.

Supplementary European Search Report for Application No. EP 12 85 8458 dated Jun. 30, 2015.

International Search Report for PCT/JP2012/007720 dated Mar. 5, 2013 including English translation.

(Continued)

*Primary Examiner* — Scott Kastler
*Assistant Examiner* — Vanessa T Luk
(74) *Attorney, Agent, or Firm* — RatnerPrestia

(57) ABSTRACT

A high strength cold rolled steel sheet has a chemical composition including, by mass %, C: 0.06 to 0.13%, Si: 1.2 to 2.3%, Mn: 0.6 to 1.6%, P: not more than 0.10%, S: not more than 0.010%, Al: 0.01 to 0.10% and N: not more than 0.010%, the balance comprising Fe and inevitable impurities. The steel sheet includes a microstructure containing not less than 90% in terms of volume fraction of ferrite with an average grain diameter of less than 20 μm and 1.0 to 10% in terms of volume fraction of pearlite with an average grain diameter of less than 5 μm. The ferrite has an average Vickers hardness of not less than 130. The steel sheet has a yield ratio of not less than 65% and a tensile strength of not less than 590 MPa.

7 Claims, No Drawings

(56) References Cited

FOREIGN PATENT DOCUMENTS

| | | | | |
|---|---|---|---|---|
| JP | 2011168880 | | 9/2011 | |
| WO | WO 2010098416 | A1 * | 9/2010 | ..... C21D 8/0205 |
| WO | WO 2011/090179 | A1 | 7/2011 | |
| WO | WO 2011/090182 | A1 | 7/2011 | |
| WO | WO 2011/090184 | A1 | 7/2011 | |

OTHER PUBLICATIONS

Written Opinion of the International Searching Authority for International Application No. PCT/JP2012/007720, including English translation.

Chinese Office Action for Chinese Application No. 201280061365.4, dated May 4, 2017, with Concise Statement of Relevance of Office Action—6 Pages.

* cited by examiner

HIGH STRENGTH COLD ROLLED STEEL SHEET WITH HIGH YIELD RATIO AND METHOD FOR PRODUCING THE SAME

CROSS REFERENCE TO RELATED APPLICATIONS

This is the U.S. National Phase application of PCT/JP2012/007720, filed Dec. 3, 2012, which claims priority to Japanese Patent Application No. 2011-270933, filed Dec. 12, 2011, the disclosures of each of these applications being incorporated herein by reference in their entireties for all purposes.

FIELD OF THE INVENTION

Aspects of the present invention relate to high strength cold rolled steel sheets with high yield ratio which have excellent elongation and stretch-flange-formability, and to methods for producing the same. In particular, aspects of the invention relate to high strength cold rolled steel sheets suited as parts of structural components for structures such as automobiles. The yield ratio (YR) is a ratio of yield stress (YS) to tensile strength (TS), and is represented by YR (%)=(YS/TS)×100.

BACKGROUND OF THE INVENTION

In recent years, $CO_2$ emissions regulations have become stricter due to the increasing concern over environmental problems. The automobile industry has been confronted with the challenge of enhancing fuel efficiency by reducing the weight of automobile bodies. Thus, thickness reduction has been pursued by adopting high strength steel sheets for automobile components. In detail, steel sheets having a tensile strength of 590 MPa or more have come to be used for the manufacturing of components that used to be made from steel sheets with a tensile strength of 270 to 440 MPa.

Steel sheets with 590 MPa or higher tensile strength are required to be excellent in workability such as elongation and stretch-flange-formability (flange forming property) from the viewpoint of formability, and are also required to have high crash absorption energy characteristics. Increasing the yield ratio is effective for enhancing crash absorption energy characteristics, and makes it possible for the steel to absorb crash energy efficiently even with small deformation.

Steel sheets may be strengthened to achieve a tensile strength of not less than 590 MPa by way of the hardening of ferrite that is the mother phase or by utilizing hard phases such as martensite and non-recrystallized ferrite. Methods associated with the hardening of ferrite include solid solution strengthening by the addition of such elements as Si and Mn, and precipitation strengthening by the addition of carbide-forming elements such as Nb and Ti. For example, Patent Literatures 1 to 3 propose steel sheets obtained through precipitation strengthening by the addition of Nb and Ti.

On the other hand, the utilization of hard phases is described in Patent Literature 4, which discloses high strength steel sheets with excellent stretch-flange-formability and anti-crash property in which the main phase is a ferrite phase, the second phase is composed of a martensite phase, the maximum grain diameter of the martensite phase is not more than 2 μm, and the area fraction of the martensite phase is not less than 5%. Patent Literature 5 discloses high strength cold rolled steel sheets with excellent workability and anti-crash property which are obtained through Nb and Ti precipitation strengthening and further contain non-recrystallized ferrite and pearlite. Methods for manufacturing such high strength cold rolled steel sheets are also disclosed in the same literature. Further, techniques are proposed (for example, Patent Literatures 6 and 7) to enhance both the strength and the stretch-flange-formability of steel sheets which have a microstructure including ferrite and pearlite.

[PTL 1] Japanese Patent No. 2688384

[PTL 2] Japanese Unexamined Patent Application Publication No. 2008-174776

[PTL 3] Japanese Unexamined Patent Application Publication No. 2009-235441

[PTL 4] Japanese Patent No. 3887235

[PTL 5] Japanese Unexamined Patent Application Publication No. 2009-185355

[PTL 6] Japanese Patent No. 4662175

[PTL 7] Japanese Patent No. 4696870

SUMMARY OF THE INVENTION

From the viewpoint of formability, however, insufficient elongation is caused by the approaches involving precipitation strengthening by the addition of carbide-forming elements such as Nb and Ti as described in Patent Literatures 1 to 3. Further, such steel sheets precipitation strengthened by utilizing carbides of elements such as Nb and Ti have a problem in that the precipitates are coarsened depending on the hot rolling conditions or the annealing conditions with the result that significant unevenness in material property is caused in volume production.

Patent Literature 4, which utilizes martensite, has a drawback in that stretch-flange-formability is insufficient, and Patent Literature 5 involving non-recrystallized ferrite and pearlite is to be improved in terms of elongation.

The tensile strength obtained in Patent Literatures 6 and 7 is 500 MPa or below and it will be difficult to increase the strength to 590 MPa or above.

To solve the problems in the art described hereinabove, aspects of the invention provide high strength cold rolled steel sheets with high yield ratio which exhibit excellent workability, namely, excellent elongation and stretch-flange-formability and which have a tensile strength of not less than 590 MPa, and to provide methods for producing such steel sheets.

The present inventors have found that high strength cold rolled steel sheets having a high yield ratio of not less than 65% as well as excellent elongation and stretch-flange-formability may be obtained by a process in which a steel sheet containing an appropriate amount of silicon is soaked at an appropriate annealing temperature so as to control the volume fraction of austenite during annealing and thereafter the steel sheet is cooled at an appropriate cooling rate to form a microstructure of annealed sheet in which solid solution strengthened fine ferrite and fine pearlite are present in appropriate volume fractions.

It has been conventionally believed that the generation of pearlite as the second phase causes deteriorations in elongation and stretch-flange-formability. However, the present inventors have found that the addition of an appropriate amount of silicon as a steel sheet component to the microstructure of steel sheet containing ferrite and pearlite results in solid solution strengthening of ferrite and thus reduces the difference in hardness from the hard phase, and have also found that the void (crack) generation at interfaces between ferrite and pearlite is restrained by controlling the ferrite and pearlite volume fractions and reducing the average grain diameters of these grains, thereby enhancing local elongation and hence improving elongation and stretch-flange-formability.

In detail, high strength cold rolled steel sheets with excellent elongation and stretch-flange-formability which have an average Vickers hardness of ferrite of not less than 130, a yield ratio of not less than 65% and a tensile strength of not less than 590 MPa may be obtained by adding 1.2 to 2.3% Si as a steel sheet component and controlling the microstructure of the steel sheet such that the volume fraction of ferrite having an average grain diameter of less than 20 μm will be not less than 90% and such that the volume fraction of pearlite having an average grain diameter of less than 5 μm will be in the range of 1.0 to 10%.

Specifically, aspects of the present invention provide the following (1) to (6).

(1) A high strength cold rolled steel sheet with high yield ratio including, by mass %, C: 0.06 to 0.13%, Si: 1.2 to 2.3%, Mn: 0.6 to 1.6%, P: not more than 0.10%, S: not more than 0.010%, Al: 0.01 to 0.10% and N: not more than 0.010%, the balance comprising Fe and inevitable impurities, the steel sheet including a microstructure containing not less than 90% in terms of volume fraction of ferrite with an average grain diameter of less than 20 μm and 1.0 to 10% in terms of volume fraction of pearlite with an average grain diameter of less than 5 μm, the ferrite having an average Vickers hardness of not less than 130, the steel sheet having a yield ratio of not less than 65% and a tensile strength of not less than 590 MPa.

(2) The high strength cold rolled steel sheet with high yield ratio described in (1), wherein the microstructure further contains less than 5% in terms of volume fraction of martensite with an average grain diameter of less than 5 μm.

(3) The high strength cold rolled steel sheet with high yield ratio described in (1) or (2), further including, by mass %, at least one element selected from the group consisting of V: not more than 0.10%, Ti: not more than 0.10%, Nb: not more than 0.10%, Cr: not more than 0.50%, Mo: not more than 0.50%, Cu: not more than 0.50%, Ni: not more than 0.50% and B: not more than 0.0030%.

(4) A method for producing a high strength cold rolled steel sheet with high yield ratio, including:

providing a steel slab including, by mass %, C: 0.06 to 0.13%, Si: 1.2 to 2.3%, Mn: 0.6 to 1.6%, P: not more than 0.10%, S: not more than 0.010%, Al: 0.01 to 0.10% and N: not more than 0.010%, the balance comprising Fe and inevitable impurities;

hot rolling the steel slab under conditions of a hot rolling starting temperature of 1150 to 1300° C. and a finishing delivery temperature of 850 to 950° C.;

subjecting the hot rolled steel sheet resulting from the hot rolling to cooling, coiling at 350 to 600° C., pickling and cold rolling to produce a cold rolled steel sheet;

heating the cold rolled steel sheet at an average heating rate of 3 to 30° C./sec. to a temperature in the range of from $Ac_3-120°$ C.$-\{([Si]/[Mn])\times 10\}°$ C. to $Ac_3-\{([Si]/[Mn])\times 10\}°$ C. wherein [Si] is the Si content (mass %) and [Mn] is the Mn content (mass %), and soaking the steel sheet at the temperature for 30 to 600 seconds;

cooling the soaked steel sheet from the soaking temperature to a first cooling temperature in the temperature range of 500 to 600° C. at an average cooling rate of 1.0 to 12° C./sec.; and thereafter cooling the steel sheet from the first cooling temperature to room temperature at an average cooling rate of not more than 5° C./sec.

(5) The method for producing a high strength cold rolled steel sheet with high yield ratio described in (4), wherein the cooling of the hot rolled steel sheet is performed in such a manner that the cooling is started within 1 second after the completion of finish rolling, and the steel sheet is cooled to a cooling end temperature in the temperature range of 650 to 750° C. at an average cooling rate of not less than 20° C./sec. and is air-cooled from the cooling end temperature to 600° C. in a cooling time of not less than 5 seconds.

(6) The method for producing a high strength cold rolled steel sheet with high yield ratio described in (4) or (5), wherein the steel slab further includes, by mass %, at least one element selected from the group consisting of V: not more than 0.10%, Ti: not more than 0.10%, Nb: not more than 0.10%, Cr: not more than 0.50%, Mo: not more than 0.50%, Cu: not more than 0.50%, Ni: not more than 0.50% and B: not more than 0.0030%.

According to aspects of the present invention, the chemical composition and the microstructure of steel sheets are controlled and thereby high strength cold rolled steel sheets with high yield ratio and excellent elongation and stretch-flange-formability may be produced stably. In detail, the inventive high strength cold rolled steel sheets have a tensile strength of not less than 590 MPa and a yield ratio of not less than 65%.

DETAILED DESCRIPTION OF EMBODIMENTS OF THE INVENTION

Hereinbelow, aspects of the present invention will be described in detail.

The reasons why the chemical composition of the inventive high strength cold rolled steel sheets is limited will be described. In the following description, the unit "%" indicates mass % of the components.

C: 0.06 to 0.13%

Carbon is an effective element for increasing the strength of steel sheets. This element also contributes to strengthening by being involved in the formation of the second phase including pearlite and martensite. In order to obtain these effects, carbon is to be added in not less than 0.06%, and preferably not less than 0.08%. On the other hand, spot weldability is lowered if an excessively large amount of carbon is added. Thus, the upper limit is specified to be 0.13%. The C content is preferably not more than 0.11%.

Si: 1.2 to 2.3%

Silicon contributes to strengthening by way of solid solution strengthening. Silicon has a high performance in work hardening to realize a relatively small decrease in elongation for the increase in strength. Thus, silicon contributes to enhancing the strength-elongation balance and the strength-flange formability balance. The addition of an appropriate amount of silicon restrains the void generation at ferrite-pearlite interfaces. In order to obtain the same effect with martensite and pearlite, silicon is to be added in not less than 1.2%, and preferably not less than 1.4%. On the other hand, the addition of more than 2.3% silicon results in a decrease in ferrite ductility. Thus, the Si content is limited to not more than 2.3%. The Si content is preferably not more than 2.1%.

Mn: 0.6 to 1.6%

Manganese contributes to strengthening by way of solid solution strengthening and the formation of the second phase. In order to obtain these effects, the Mn content is to be not less than 0.6%, and preferably not less than 0.9%. On the other hand, manganese, when present in an excessively large content, inhibits the formation of pearlite and thus tends to cause excessive formation of martensite. Thus, the Mn content is limited to not more than 1.6%.

P: not more than 0.10%

Phosphorus contributes to strengthening by way of solid solution strengthening. When added in an excessively large amount, however, phosphorus is markedly segregated at grain boundaries to make the grain boundaries brittle and to cause a decrease in weldability. Thus, the P content is limited to not more than 0.10%, and preferably not more than 0.05%.

S: not more than 0.010%

If the S content is high, large amounts of sulfides such as MnS are formed to cause a decrease in local elongation represented by stretch-flange-formability. Thus, the upper limit of the S content is specified to be 0.010%. The S content is preferably not more than 0.0050%. The lower limit is not particularly specified. However, the S content is preferably not less than 0.0005% because removing sulfur to an extremely low content increases steelmaking costs.

Al: 0.01 to 0.10%

Aluminum is necessary for deoxidation. In order to obtain this effect, the Al content is to be not less than 0.01%. However, adding more than 0.10% aluminum no longer increases the effect. Thus, the Al content is limited to not more than 0.10%, and preferably not more than 0.05%.

N: not more than 0.010%

It is necessary that the N content be low because nitrogen forms coarse nitrides to deteriorate bendability and stretch-flange-formability. This tendency becomes marked when the N content is in excess of 0.010%. Thus, the N content is limited to not more than 0.010%. The N content is preferably not more than 0.0050%.

In aspects of the invention, one or more of the following components may be added in addition to the aforementioned components.

V: not more than 0.10%

Vanadium can contribute to increasing the strength by forming fine carbonitride. In order to obtain this effect, vanadium is preferably added in not less than 0.01%. On the other hand, adding vanadium in an amount exceeding 0.10% does not give a corresponding large increase in strength but causes an increase in alloying costs. Thus, the V content is preferably not more than 0.10%.

Ti: not more than 0.10%

Similarly to vanadium, titanium is an optional component that can contribute to increasing the strength by forming fine carbonitride. In order to obtain this effect, the Ti content is preferably not less than 0.005%. On the other hand, adding titanium in an excessively large amount results in a marked decrease in elongation. Thus, the Ti content is preferably not more than 0.10%.

Nb: not more than 0.10%

Similarly to vanadium, niobium is an optional component that can contribute to increasing the strength by forming fine carbonitride. In order to obtain this effect, the Nb content is preferably not less than 0.005%. On the other hand, adding niobium in an excessively large amount results in a marked decrease in elongation. Thus, the Nb content is preferably not more than 0.10%.

Cr: not more than 0.50%

Chromium contributes to strengthening by forming the second phase, and may be added as required. In order to obtain this effect, the Cr content is preferably not less than 0.10%. On the other hand, adding chromium in excess of 0.50% tends to inhibit the formation of pearlite. Thus, the Cr content is limited to not more than 0.50%.

Mo: not more than 0.50%

Molybdenum is an optional component that contributes to strengthening by forming the second phase as well as contributes to strengthening by partially forming carbide. In order to obtain these effects, it is preferable that molybdenum be added in not less than 0.05%. On the other hand, the Mo content is preferably not more than 0.50% because the increase in the effects is saturated after 0.50%.

Cu: not more than 0.50%

Copper is an optional component that contributes to strengthening by way of solid solution strengthening as well as contributes to strengthening by forming the second phase. In order to obtain these effects, it is preferable that copper be added in not less than 0.05%. On the other hand, the Cu content is preferably not more than 0.50% because adding more than 0.50% copper no longer increases the effects and will raise the probability of the occurrence of surface defects ascribed to copper.

Ni: not more than 0.50%

Similarly to copper, nickel is an optional component that contributes to strengthening by way of solid solution strengthening as well as contributes to strengthening by forming the second phase. In order to obtain these effects, it is preferable that nickel be added in not less than 0.05%. Further, the addition of nickel is effective when copper is added because nickel, when added together with copper, reduces the occurrence of surface defects ascribed to copper. On the other hand, the Ni content is preferably not more than 0.50% because adding more than 0.50% nickel no longer increases the effects.

B: not more than 0.0030%

Boron is an optional component that contributes to strengthening by enhancing hardenability and by forming the second phase. In order to obtain these effects, it is preferable that boron be added in not less than 0.0005%. On the other hand, the B content is limited to not more than 0.0030% because the effects are no longer increased by adding more than 0.0030% boron.

The balance after the deduction of the aforementioned components is iron and inevitable impurities. Examples of the inevitable impurities include Sb, Sn, Zn and Co. The acceptable contents of these impurities are Sb: not more than 0.01%, Sn: not more than 0.1%, Zn: not more than 0.01% and Co: not more than 0.1%. The advantageous effects of aspects of the invention are not impaired even when Ta, Mg, Ca, Zr and REM are contained in the usual contents.

Next, the microstructure of the inventive high strength cold rolled steel sheets will be described in detail.

Ferrite has an average grain diameter of less than 20 μm, a volume fraction of not less than 90% and an average Vickers hardness (HV) of not less than 130. Pearlite has an average grain diameter of less than 5 μm and a volume fraction of 1.0 to 10%. Here, the volume fraction is relative to the total volume of the steel sheet.

If the volume fraction of ferrite is less than 90%, the hard second phase represents a correspondingly increased fraction and thus causes a significant hardness difference from the soft ferrite at many locations, resulting in a decrease in stretch-flange-formability. Thus, the volume fraction of ferrite is limited to not less than 90%, and preferably not less than 92%. If the average grain diameter of ferrite is 20 μm or above, good stretch-flange-formability is not obtained because voids are prone to be formed at the burr ends during flange forming or hole expansion. Thus, the average grain diameter of ferrite is limited to less than 20 μm, and preferably less than 15 μm. If the HV of ferrite is less than 130, stretch-flange-formability is lowered due to the failure of effectively suppressing the void (crack) generation at interfaces between ferrite and pearlite. Thus, the HV of ferrite is limited to not less than 130, and preferably not less than 150.

If the volume fraction of pearlite is less than 1.0%, only a low strengthening effect is obtained. In order to balance strength and formability, the volume fraction of pearlite is limited to not less than 1.0%. On the other hand, any volume fraction of pearlite exceeding 10% causes marked void generation at interfaces between ferrite and pearlite and such voids tend to be connected together. Thus, the volume fraction of pearlite is limited to not more than 10%, and preferably not more than 8% from the viewpoint of workability. If the average grain diameter of pearlite is 5 μm or more, voids will be formed at an increased number of sites and local elongation will be lowered. As a result, good elongation and stretch-flange-formability cannot be obtained. Thus, the average grain diameter of pearlite is limited to less than 5 μm, and preferably not more than 3.5 μm.

The microstructure of the steel sheet may contain martensite as long as the volume fraction of martensite with an average grain diameter of less than 5 μm is below 5%, in which case advantages deriving from aspects of the invention may be achieved without causing a decrease in stretch-flange-formability. If the volume fraction of such martensite is 5% or more, it is highly probable that the yield ratio will be not more than 65%. Thus, the volume fraction of martensite is limited to less than 5%. If the average grain diameter is 5 μm or more, good stretch-flange-formability is not obtained because voids tend to be formed at the burr ends during flange forming or hole expansion. Thus, the average grain diameter is limited to less than 5 μm.

Although one, or two or more types of other phases such as bainite, retained γ and spherical cementite may occur in addition to the ferrite, pearlite and martensite, advantages deriving from aspects of the invention may be achieved as long as the above configurations such as the volume fractions of ferrite and pearlite are satisfied.

Next, a method for producing the high strength cold rolled steel sheets of aspects of the invention will be described.

The high strength cold rolled steel sheet of aspects of the invention may be produced by a series of steps in which a steel slab having the aforementioned chemical composition is hot rolled under conditions in which the hot rolling starting temperature is 1150 to 1300° C. and the finishing delivery temperature is 850 to 950° C., then the hot rolled steel sheet is subjected to cooling, coiling at the temperature range of 350 to 600° C., pickling and cold rolling, thereafter the cold rolled steel sheet is heated at an average heating rate of 3 to 30° C./sec. to a temperature in the range of from $Ac_3-120°$ C.$-\{([Si]/[Mn])\times 10\}°$ C. to $Ac_3-\{([Si]/[Mn])\times 10\}°$ C. ([Si] and [Mn] are the contents of Si and Mn (mass %)) and is soaked at the temperature for 30 to 600 seconds, and the steel sheet is cooled from the soaking temperature to a first cooling temperature in the temperature range of 500 to 600° C. at an average cooling rate of 1.0 to 12° C./sec., and is thereafter cooled from the first cooling temperature to room temperature at an average cooling rate of not more than 5° C./sec.

The steel slab that is used is preferably manufactured by a continuous casting method in order to prevent macroscopic segregation of the components, but may be produced also by an ingot making method or a thin slab casting method. According to the conventional practice, the steel slab produced may be cooled to room temperature and be thereafter reheated. Alternatively, energy-saving processes such as direct-feed rolling or direct rolling processes may be adopted without problems. That is, the steel slab at a warm temperature may be fed into the heating furnace without being cooled, or may be rolled immediately after being kept at a hot temperature, or may be rolled directly after being cast.

(Hot Rolling Step)

Hot rolling starting temperature: 1150 to 1300° C.

In the hot rolling step, the hot rolling of the steel slab is started at 1150 to 1300° C., or the hot rolling is started after the steel slab is reheated to 1150 to 1300° C. Starting the hot rolling at below 1150° C. incurs high rolling load and results in a decrease in productivity. On the other hand, heating costs are increased if the hot rolling starting temperature is above 1300° C. Thus, the hot rolling starting temperature is limited to 1150 to 1300° C.

Finishing delivery temperature: 850 to 950° C.

It is necessary that the hot rolling be finished in the austenite single phase region in order to ensure that the steel sheet has a uniform microstructure and a low anisotropy of material property and thereby that enhanced elongation and stretch-flange-formability are obtained after annealing. Thus, the finishing delivery temperature is specified to be not less than 850° C. If the finishing delivery temperature is above 950° C., the microstructure of the hot rolled steel sheet is coarsened and the post-annealing properties may be deteriorated. Thus, the finishing delivery temperature is limited to 850 to 950° C.

After the finish rolling, the steel sheet is cooled. The conditions of cooling after the finish rolling are not particularly limited. However, it is preferable that the steel sheet be cooled under the following cooling conditions.

Conditions of cooling after finish rolling:

The cooling after the finish rolling is preferably performed under such conditions that the cooling is started within 1 second after the completion of the hot rolling, and the steel sheet is cooled to a cooling end temperature in the temperature range of 650 to 750° C. at an average cooling rate of not less than 20° C./sec. and is air-cooled from the cooling end temperature to 600° C. in a cooling time of not less than 5 seconds.

By rapidly cooling the steel sheet to the ferrite region after the completion of the finish rolling, ferrite transformation can be promoted and fine ferrite grain diameters can be obtained. Thus, the ferrite grain diameters after annealing can be reduced and stretch-flange-formability is enhanced. If the hot rolled sheet resulting from the finish rolling is allowed to remain (is held) at the high temperature, the ferrite grains become coarsened to large diameters. In order to obtain fine ferrite grains, it is preferable that the cooling be started within 1 second after the completion of the finish rolling, and the steel sheet be rapidly cooled to a cooling end temperature in the temperature range of 650 to 750° C. at an average cooling rate of not less than 20° C./sec. In order to promote the transformation of ferrite phase without causing the ferrite grains to become coarsened, it is preferable that the steel sheet that has been rapidly cooled be air-cooled from the cooling end temperature to 600° C. in a cooling time of not less than 5 seconds.

Coiling temperature: 350 to 600° C.

Coiling at a temperature higher than 600° C. causes the ferrite grains to be coarsened. Thus, the coiling temperature is limited to not more than 600° C. On the other hand, coiling at a temperature lower than 350° C. results in excessive formation of hard martensite phase and consequently the cold rolling load is increased, thereby deteriorating productivity. Thus, the coiling temperature is limited to not less than 350° C.

(Pickling Step)

After the hot rolling step, a pickling step is preferably performed to remove scales on the surface of the hot rolled sheet. The pickling step is not particularly limited and may be carried out according to the common procedure.

(Cold Rolling Step)

The hot rolled and pickled sheet is then subjected to a cold rolling step in which the steel sheet is rolled to give a cold rolled sheet having a prescribed sheet thickness. The cold rolling step is not particularly limited and may be carried out according to the common procedure.

(Annealing Step)

The annealing step is performed to promote recrystallization as well as to form a second phase structure including pearlite and martensite for strengthening. Specifically, the annealing step is conducted in such a manner that the steel sheet is heated at an average heating rate of 3 to 30° C./sec. to a temperature in the range of from $Ac_3$−120° C.−{([Si]/[Mn])×10}° C. to $Ac_3$−{([Si]/[Mn])×10}° C. (wherein [Si] and [Mn] are the contents (mass %) of Si and Mn), then soaked at the temperature for 30 to 600 seconds, thereafter cooled (primary cooling) from the soaking temperature to a first cooling temperature in the temperature range of 500 to 600° C. at an average cooling rate of 1.0 to 12° C./sec., and cooled (secondary cooling) from the first cooling temperature to room temperature at an average cooling rate of not more than 5° C./sec.

Average heating rate: 3 to 30° C./sec.

Stable material property may be obtained by allowing recrystallization to proceed to a sufficient extent in the ferrite region before the steel sheet is heated to the two-phase region. Rapid heating does not allow sufficient progression of recrystallization, and hence the upper limit of the average heating rate is specified to be 30° C./sec. On the other hand, too slow a heating rate causes the ferrite grains to become coarsened and the prescribed average grain diameter cannot be obtained. Thus, the average heating rate is limited to not less than 3° C./sec.

Soaking temperature (holding temperature): $Ac_3$−120° C.−{([Si]/[Mn])×10}° C. to $Ac_3$−{([Si]/[Mn])×10}° C.

It is necessary that the soaking temperature be in the two-phase, namely, ferrite-austenite region and be in an appropriate temperature range determined in consideration of the Si and Mn contents. Soaking at such an appropriate temperature makes it possible to obtain the prescribed volume fractions and average grain diameters of ferrite and pearlite. If the soaking temperature is below $Ac_3$−120° C.−{([Si]/[Mn])×10}° C., the volume fraction of austenite during annealing is so small that the prescribed volume fraction of pearlite necessary to ensure strength cannot be obtained. If the soaking temperature is above $Ac_3$−{([Si]/[Mn])×10}° C., the volume fraction of austenite during annealing is so large and the austenite grain diameters are so increased that the prescribed average grain diameter of pearlite cannot be obtained. Thus, the soaking temperature is limited to the range of from $Ac_3$−120° C.−{([Si]/[Mn])×10}° C. to $Ac_3$−{([Si]/[Mn])×10}° C., and preferably from $Ac_3$−100° C.−{([Si]/[Mn])×10}° C. to $Ac_3$−{([Si]/[Mn])×10}° C. Here, $Ac_3$ is represented by the following equation.

$$Ac_3(°\,C.)=910-203\sqrt{[C]}-15.2\times[Ni]+44.7\times[Si]+104\times[V]+31.5\times[Mo]-30\times[Mn]-11\times[Cr]-20\times[Cu]+700\times[P]+400\times[Ti]+400\times[Al]$$

In the equation, [C], [Ni], [Si], [V], [Mo], [Mn], [Cr], [Cu], [P], [Ti] and [Al] indicate the contents (mass %) of C, Ni, Si, V, Mo, Mn, Cr, Cu, P, Ti and Al, respectively.

Soaking time: 30 to 600 seconds

The required soaking time is at least 30 seconds to ensure that recrystallization will proceed and partial austenite transformation will take place at the above soaking temperature. On the other hand, excessively long soaking causes the coarsening of ferrite and hence the prescribed average grain diameter cannot be obtained. Thus, the soaking time needs to be not more than 600 seconds, and preferably not more than 500 seconds.

Average rate of cooling from soaking temperature to temperature of 500 to 600° C.: 1.0 to 12° C./sec.

In the primary cooling, the steel sheet is cooled from the soaking temperature to 500 to 600° C. (the first cooling temperature) at an average cooling rate of 1.0° C./sec. to 12° C./sec. in order to control the microstructure of the final steel sheet obtained after the annealing step such that the volume fraction of ferrite with an average grain diameter of less than 20 μm will be not less than 90% and the volume fraction of pearlite with an average grain diameter of less than 5 μm will be 1.0 to 10%. If the first cooling temperature is above 600° C., pearlite is not formed sufficiently. Cooling to below 500° C. results in excessive formation of the second phase such as bainite. By limiting the first cooling temperature to the range of from 500 to 600° C., the volume fraction of pearlite may be controlled. If the average rate of cooling to the temperature range of 500 to 600° C. is less than 1.0° C./sec., pearlite will not attain a volume fraction of 1.0% or more. Cooling at an average rate exceeding 12° C./sec. causes martensite to be formed with an excessively large volume fraction. The average cooling rate is preferably not more than 10° C./sec.

Average rate of cooling from first cooling temperature to room temperature: not more than 5° C./sec.

After being cooled to the first cooling temperature (500 to 600° C.), the steel sheet is subjected to secondary cooling in which it is cooled to room temperature at an average cooling rate of not more than 5° C./sec. If the average cooling rate exceeds 5° C./sec., the volume fraction of martensite is excessively increased. Thus, the average rate of cooling from the first cooling temperature is limited to not more than 5° C./sec., and preferably not more than 3° C./sec.

Temper rolling may be performed after the annealing. The elongation ratio is preferably in the range of 0.3 to 2.0%.

Without departing from the scope of the invention, the steel sheet may be galvanized after the primary cooling in the annealing step to give a galvanized steel sheet. Further, the galvanized steel sheet may undergo alloying treatment to form a galvannealed steel sheet.

EXAMPLES

Hereinbelow, Examples of the present invention will be described.

The scope of the present invention is not limited by the following Examples, and appropriate modifications may be made without departing from the spirit of the invention. Such modifications also fall within the technical scope of the invention.

Steels having chemical compositions shown in Table 1 (balance: Fe and inevitable impurities) were refined and cast to produce 230 mm thick slabs, which were then hot rolled under conditions in which the hot rolling starting temperature was 1200° C. and the finishing delivery temperature (FDT) was a temperature described in Table 2. After the completion of finish rolling, cooling was started after 0.1 second and the steel sheets were cooled to a cooling end temperature described in Table 2 at an average cooling rate shown in Table 2. The steel sheets were then air-cooled from the cooling end temperature to 600° C. in a cooling time of 6 seconds. Hot rolled steel sheets with a sheet thickness of 3.2 mm were thus produced. Thereafter, the steel sheets were coiled at a coiling temperature (CT) described in Table 2, pickled, and cold rolled to produce cold rolled steel sheets having a sheet thickness of 1.4 mm. Thereafter, the steel sheets were annealed under conditions in which they were heated to a soaking temperature shown in Table 2 at an average heating rate described in Table 2, then soaked at the soaking temperature for a soaking time described in Table 2, subsequently cooled to a first cooling temperature described in Table 2 at an average primary cooling rate shown in Table 2, and cooled from the first cooling temperature to room temperature at an average secondary cooling rate described in Table 2. The steel sheets were then temper rolled (elongation ratio: 0.7%). High strength cold rolled steel sheets were thus manufactured.

From the steel sheets manufactured, JIS No. 5 tensile test pieces were sampled such that the longitudinal direction (the tensile direction) would be perpendicular to the rolling direction. Tensile test (JIS 22241 (1998)) was performed to determine the yield strength (YS), the tensile strength (TS), the total elongation (EL) and the yield ratio (YR). Steel sheets with an EL of not less than 30% were evaluated to have good elongation, and those with a YR of not less than 65% were evaluated as having a high yield ratio.

Flange formability was evaluated as follows. In accordance with The Japan Iron and Steel Federation Standards (JFS T1001 (1996)), the test piece was punched to form a hole 10 mm in diameter with a clearance of 12.5% and was set onto a tester such that the burr was on the die side. The test piece was then processed with a 60° conical punch to determine the hole expansion ratio (λ). Steel sheets having a λ value (%) of not less than 80% were evaluated as having good stretch-flange-formability.

To evaluate the microstructures of the steel sheets, the volume fractions and the average (crystal) grain diameters of ferrite, pearlite and martensite were measured by the following method.

For the observation of the microstructure of the steel sheet, a cross section of the steel sheet along the rolling direction (at a depth of ¼ sheet thickness) was etched with a 3% Nital reagent (3% nitric acid+ethanol). The microstructure was then observed and micrographed by using a optical microscope at a magnification of 500-1000 times and by using (scanning and transmission) electron microscopes at a magnification of 1000-10000 times. The micrographs were analyzed to quantitatively determine the volume fraction and the average crystal grain diameter of ferrite, the volume fraction and the average crystal grain diameter of pearlite, and the volume fraction and the average crystal grain diameter of martensite. Twelve fields of view were observed for each structure, and the area percentage was measured by a point count method (in accordance with ASTM E562-83 (1988)). The volume fraction was obtained based on the area percentage. Ferrite is represented by relatively black regions in the contrast; pearlite is a layered structure in which plates of ferrite and cementite are disposed alternately; and martensite is shown in white in the contrast. The measurement of the average crystal grain diameters of ferrite, pearlite and martensite involved Image-Pro manufactured by Media Cybernetics. With respect to the micrographs of the steel sheet microstructure mentioned above, the ferrite crystal grains, the pearlite crystal grains and the martensite crystal grains were identified beforehand. The micrographs were then captured to make it possible to calculate the areas of the respective phases. The circular equivalent diameters of the grains were calculated, and the results were averaged.

The Vickers hardness of the ferrite phase was measured in accordance with JIS 22244 (2009) with use of a micro Vickers hardness tester. The measurement conditions were such that the load was 10 gf and the load application time was 15 seconds. The hardness was measured with respect to ten sites in the ferrite crystal grains, and the results were averaged.

Table 3 describes the results of the measurement and evaluation of tensile characteristics, stretch-flange-formability and steel sheet microstructure.

TABLE 1

| | Chemical composition (mass %) | | | | | | | | | | | |
|---|---|---|---|---|---|---|---|---|---|---|---|---|
| Steels | C | Si | Mn | P | S | Al | N | Others | $Ac_3$ (° C.) | $Ac_3$ − 120 − ([Si]/[Mn]) × 10 (° C.) | $Ac_3$ − ([Si]/[Mn]) × 10 (° C.) | Remarks |
| A | 0.09 | 1.91 | 1.03 | 0.01 | 0.003 | 0.03 | 0.003 | — | 923 | 784 | 904 | Inv. Steel |
| B | 0.11 | 1.73 | 1.22 | 0.02 | 0.003 | 0.03 | 0.003 | — | 909 | 775 | 895 | Inv. Steel |
| C | 0.09 | 1.46 | 1.44 | 0.01 | 0.002 | 0.03 | 0.002 | — | 890 | 760 | 880 | Inv. Steel |
| D | 0.09 | 1.56 | 1.33 | 0.01 | 0.003 | 0.03 | 0.003 | V: 0.02 | 900 | 768 | 888 | Inv. Steel |
| E | 0.08 | 1.78 | 1.21 | 0.02 | 0.003 | 0.03 | 0.003 | Ti: 0.02 | 930 | 795 | 915 | Inv. Steel |
| F | 0.07 | 1.65 | 1.43 | 0.01 | 0.003 | 0.03 | 0.003 | Nb: 0.02 | 906 | 775 | 895 | Inv. Steel |
| G | 0.09 | 1.88 | 0.83 | 0.01 | 0.004 | 0.03 | 0.003 | Cr: 0.20 | 925 | 782 | 902 | Inv. Steel |
| H | 0.11 | 1.95 | 0.72 | 0.01 | 0.003 | 0.04 | 0.003 | Mo: 0.20 | 938 | 790 | 910 | Inv. Steel |
| I | 0.10 | 1.84 | 0.98 | 0.01 | 0.003 | 0.03 | 0.003 | Cu: 0.10 | 916 | 777 | 897 | Inv. Steel |
| J | 0.10 | 1.65 | 1.23 | 0.01 | 0.003 | 0.03 | 0.003 | Ni: 0.10 | 900 | 767 | 887 | Inv. Steel |
| K | 0.10 | 1.53 | 1.02 | 0.01 | 0.003 | 0.03 | 0.003 | B: 0.0015 | 903 | 768 | 888 | Inv. Steel |
| L | 0.09 | 2.45 | 0.72 | 0.01 | 0.003 | 0.04 | 0.002 | — | 960 | 806 | 926 | Comp. Steel |
| M | 0.11 | 1.12 | 1.56 | 0.01 | 0.003 | 0.03 | 0.003 | — | 865 | 738 | 858 | Comp. Steel |
| N | 0.10 | 1.53 | 1.72 | 0.01 | 0.003 | 0.03 | 0.003 | — | 882 | 753 | 873 | Comp. Steel |
| O | 0.11 | 2.03 | 0.48 | 0.01 | 0.003 | 0.03 | 0.003 | — | 938 | 776 | 896 | Comp. Steel |

Underlines: outside the inventive range.

TABLE 2

| Sample No. | Steels | Hot rolling conditions: FDT ° C. | Cooling end temp. ° C. | Ave. cooling rate ° C./sec. | CT ° C. | Annealing conditions: Ave. heating rate ° C./sec. | Soaking temp. ° C. | Soaking time second | First cooling temp. ° C. | Ave. prim. cooling rate ° C./sec. | Ave. sec. cooling rate ° C./sec. |
|---|---|---|---|---|---|---|---|---|---|---|---|
| 1 | A | 920 | 700 | 20 | 600 | 10 | 850 | 200 | 550 | 5 | 2.0 |
| 2 | A | 900 | 700 | 20 | 600 | 10 | 850 | 200 | 500 | 5 | 1.0 |
| 3 | A | 900 | 700 | 20 | 600 | 10 | 800 | 200 | 550 | 5 | 1.0 |
| 4 | A | 900 | 700 | 20 | 500 | 10 | 800 | 200 | 500 | 5 | 1.0 |
| 5 | A | 900 | 750 | 20 | 700 | 10 | 800 | 200 | 500 | 5 | 1.0 |
| 6 | B | 900 | 700 | 20 | 600 | 10 | 850 | 200 | 550 | 5 | 1.0 |
| 7 | C | 900 | 700 | 20 | 600 | 10 | 850 | 200 | 550 | 10 | 1.0 |
| 8 | C | 900 | 700 | 20 | 600 | 10 | 850 | 200 | 500 | 3 | 4.0 |
| 9 | C | 900 | 700 | 20 | 600 | 10 | 800 | 200 | 550 | 5 | 1.0 |
| 10 | C | 880 | 700 | 20 | 550 | 10 | 800 | 200 | 500 | 10 | 0.5 |
| 11 | C | 1050 | 700 | 20 | 650 | 10 | 850 | 200 | 550 | 10 | 1.0 |
| 12 | C | 750 | 650 | 20 | 400 | 10 | 850 | 200 | 550 | 10 | 1.0 |
| 13 | D | 900 | 700 | 20 | 600 | 10 | 820 | 200 | 550 | 5 | 1.0 |
| 14 | E | 900 | 700 | 20 | 600 | 10 | 850 | 250 | 550 | 5 | 1.0 |
| 15 | F | 900 | 700 | 20 | 600 | 10 | 850 | 250 | 550 | 5 | 1.0 |
| 16 | G | 900 | 700 | 20 | 400 | 10 | 850 | 200 | 550 | 5 | 1.0 |
| 17 | H | 950 | 700 | 20 | 600 | 10 | 850 | 200 | 550 | 5 | 1.0 |
| 18 | I | 900 | 700 | 20 | 600 | 10 | 850 | 200 | 550 | 5 | 1.0 |
| 19 | J | 900 | 700 | 20 | 600 | 10 | 850 | 200 | 550 | 5 | 0.5 |
| 20 | K | 950 | 700 | 20 | 600 | 10 | 850 | 200 | 550 | 5 | 1.0 |
| 21 | C | 900 | 700 | 20 | 600 | 10 | 930 | 500 | 550 | 2 | 1.0 |
| 22 | C | 900 | 700 | 20 | 600 | 10 | 740 | 300 | 550 | 5 | 1.0 |
| 23 | C | 900 | 700 | 20 | 600 | 10 | 820 | 200 | 550 | 20 | 1.0 |
| 24 | C | 900 | 700 | 20 | 600 | 10 | 800 | 200 | 600 | 0.5 | 1.0 |
| 25 | C | 900 | 700 | 20 | 600 | 10 | 820 | 200 | 550 | 5 | 7.0 |
| 26 | L | 900 | 700 | 20 | 600 | 10 | 820 | 200 | 550 | 5 | 1.0 |
| 27 | M | 900 | 700 | 20 | 600 | 10 | 820 | 200 | 550 | 5 | 1.0 |
| 28 | N | 900 | 700 | 20 | 600 | 10 | 820 | 200 | 550 | 5 | 1.0 |
| 29 | O | 900 | 700 | 20 | 600 | 10 | 820 | 200 | 550 | 5 | 1.0 |

Underlines: outside the inventive range.

TABLE 3

| Sample No. | Steel sheet microstructure: Ferrite Vol. fract./% | Ferrite Ave. grain diam./μm | Ferrite HV | Pearlite Vol. fract./% | Pearlite Ave. grain diam./μm | Martensite Vol. fract./% | Martensite Ave. grain diam./μm | Tensile characteristics: YS MPa | TS MPa | EL % | YR % | Hole exp. ratio λ % | Remarks |
|---|---|---|---|---|---|---|---|---|---|---|---|---|---|
| 1 | 97 | 12 | 192 | 3.0 | 2.0 | — | — | 440 | 610 | 33 | 72 | 90 | Inv. Ex. |
| 2 | 96 | 10 | 188 | 4.0 | 3.2 | — | — | 450 | 615 | 33 | 73 | 90 | Inv. Ex. |
| 3 | 96 | 9 | 188 | 4.0 | 3.3 | — | — | 452 | 606 | 35 | 75 | 95 | Inv. Ex. |
| 4 | 94 | 11 | 190 | 4.0 | 2.8 | 2 | 3.5 | 459 | 613 | 34 | 75 | 91 | Inv. Ex. |
| 5 | 96 | 21 | 188 | 4.0 | 2.9 | — | — | 465 | 599 | 30 | 78 | 73 | Comp. Ex. |
| 6 | 95 | 10 | 178 | 4.5 | 3.4 | — | — | 433 | 623 | 33 | 70 | 88 | Inv. Ex. |
| 7 | 94 | 8 | 163 | 4.0 | 3.3 | 2 | 2.9 | 418 | 590 | 34 | 71 | 92 | Inv. Ex. |
| 8 | 92 | 8 | 165 | 4.0 | 3.5 | 3 | 4.3 | 402 | 610 | 33 | 66 | 91 | Inv. Ex. |
| 9 | 96 | 10 | 168 | 4.0 | 3.0 | — | — | 409 | 590 | 35 | 69 | 108 | Inv. Ex. |
| 10 | 93 | 7 | 178 | 4.0 | 2.2 | 3 | 2.3 | 402 | 606 | 34 | 66 | 92 | Inv. Ex. |
| 11 | 97 | 22 | 169 | 3.0 | 2.3 | — | — | 435 | 588 | 31 | 74 | 68 | Comp. Ex. |
| 12 | 96 | 23 | 166 | 4.0 | 4.4 | — | — | 411 | 598 | 29 | 69 | 71 | Comp. Ex. |
| 13 | 94 | 9 | 159 | 3.0 | 4.3 | 3 | 3.5 | 405 | 613 | 35 | 66 | 81 | Inv. Ex. |
| 14 | 94 | 8 | 178 | 3.5 | 3.5 | — | — | 459 | 605 | 30 | 76 | 89 | Inv. Ex. |
| 15 | 95 | 8 | 188 | 3.4 | 3.3 | — | — | 443 | 601 | 30 | 74 | 88 | Inv. Ex. |
| 16 | 91 | 11 | 195 | 4.5 | 4.2 | 4 | 3.8 | 405 | 596 | 32 | 68 | 81 | Inv. Ex. |
| 17 | 91 | 9 | 201 | 4.3 | 3.6 | 4 | 3.2 | 411 | 603 | 33 | 68 | 83 | Inv. Ex. |
| 18 | 94 | 10 | 189 | 2.0 | 4.1 | — | — | 433 | 611 | 31 | 71 | 88 | Inv. Ex. |
| 19 | 92 | 8 | 178 | 3.6 | 3.5 | — | — | 432 | 605 | 32 | 71 | 91 | Inv. Ex. |
| 20 | 91 | 7 | 182 | 3.2 | 3.9 | 4 | 3.2 | 453 | 631 | 30 | 72 | 82 | Inv. Ex. |
| 21 | 92 | 21 | 165 | 8.0 | 6.8 | — | — | 433 | 590 | 30 | 73 | 73 | Comp. Ex. |
| 22 | 99 | 24 | 158 | 0.5 | 1.0 | — | — | 389 | 577 | 32 | 67 | 71 | Comp. Ex. |
| 23 | 92 | 8 | 163 | 1.0 | 3.6 | 7 | 4.0 | 376 | 591 | 32 | 64 | 75 | Comp. Ex. |
| 24 | 99 | 13 | 159 | 0.5 | 1.3 | — | — | 401 | 585 | 31 | 69 | 90 | Comp. Ex. |
| 25 | 89 | 9 | 168 | 5.0 | 2.4 | 6 | 3.8 | 388 | 602 | 32 | 64 | 78 | Comp. Ex. |
| 26 | 98 | 18 | 203 | 2.0 | 2.3 | — | — | 422 | 611 | 29 | 69 | 62 | Comp. Ex. |
| 27 | 88 | 11 | 145 | 5.0 | 4.6 | 7 | 4.1 | 384 | 598 | 32 | 64 | 75 | Comp. Ex. |
| 28 | 92 | 10 | 178 | 2.0 | 4.8 | 6 | 3.9 | 388 | 600 | 32 | 65 | 70 | Comp. Ex. |
| 29 | 97 | 13 | 199 | 3.0 | 4.5 | — | — | 433 | 578 | 31 | 75 | 82 | Comp. Ex. |

Underlines: outside the inventive range.

From the results in Table 3, all the steel sheets in Inventive Examples had a complex microstructure which contained not less than 90% in terms of volume fraction of ferrite with an average grain diameter of less than 20 μm and 1.0 to 10% in terms of volume fraction of pearlite with an average grain diameter of less than 5 μm and in which the average Vickers hardness of the ferrite was not less than 130. As a result, the inventive steel sheets achieved good workability with the elongation being not less than 30% and the hole expansion ratio being not less than 80% while the steel sheets ensured a tensile strength of not less than 590 MPa and a yield ratio of not less than 65%. On the other hand, the steel sheets in Comparative Examples did not satisfy the microstructure according to aspects of the invention and were consequently found to be inferior in terms of at least one of tensile strength, yield ratio, elongation and hole expansion ratio.

According to aspects of the present invention, the chemical composition and the microstructure of steel sheets are controlled and thereby high strength cold rolled steel sheets with high yield ratio and excellent elongation and stretch-flange-formability may be produced stably. In detail, the inventive high strength cold rolled steel sheets have a tensile strength of not less than 590 MPa, a yield ratio of not less than 65%, a total elongation of not less than 30% and a hole expansion ratio of not less than 80%.

The invention claimed is:

1. A high strength cold rolled steel sheet with high yield ratio comprising, by mass %, C: 0.06 to 0.13%, Si: 1.2 to 2.3%, Mn: 0.6 to 1.6%, P: not more than 0.10%, S: not more than 0.010%, Al: 0.01 to 0.10% and N: not more than 0.010%, the balance comprising Fe and inevitable impurities, the steel sheet including a microstructure consisting of not less than 90% in terms of volume fraction of ferrite with an average grain diameter of less than 20 μm, 1.0 to 10% in terms of volume fraction of pearlite with an average grain diameter of less than 5 μm, less than 5% in terms of volume fraction of martensite with an average grain diameter of less than 5 μm, the remainder of the microstructure optionally including one or more of bainite, retained y and spherical cementite, the ferrite having an average Vickers hardness of not less than 130, the steel sheet having a yield ratio of not less than 65% and a tensile strength of not less than 590 MPa.

2. The high strength cold rolled steel sheet with high yield ratio according to claim 1, further comprising, by mass %, at least one element selected from the group consisting of V: not more than 0.10%, Ti: not more than 0.10%, Nb: not more than 0.10%, Cr: not more than 0.50%, Mo: not more than 0.50%, Cu: not more than 0.50%, Ni: not more than 0.50% and B: not more than 0.0030%.

3. The high strength cold rolled steel sheet with high yield ratio according to claim 1, wherein the steel sheet has a yield strength of 402 MPa or more.

4. A method for producing a high strength cold rolled steel sheet with high yield ratio according to claim 1, comprising:

providing a steel slab including, by mass %, C: 0.06 to 0.13%, Si: 1.2 to 2.3%, Mn: 0.6 to 1.6%, P: not more than 0.10%, S: not more than 0.010%, Al: 0.01 to 0.10% and N: not more than 0.010%, the balance comprising Fe and Inevitable impurities;

hot roiling the steel slab under conditions of a hot roiling starting temperature of 1150 to 1300° C. and a finishing delivery temperature of 850 to 950° C.;

subjecting the hot rolled steel sheet resulting from the hot roiling to cooling, coiling at 350 to 600° C., pickling and cold rolling to produce a cold rolled steel sheet;

heating the cold rolled steel sheet at an average heating rate of 3 to 30° C./sec. to a temperature in the range of from $Ac_3-120°$ C.$-\{([Si]/[Mn])\times10\}°$ C. to $Ac_3-\{([Si]/[Mn])\times10\}°$ C. wherein [Si] is the Si content (mass %) and [Mn] is the Mn content (mass %), and soaking the steel sheet at the temperature for 30 to 600 seconds;

cooling the soaked steel sheet from the soaking temperature to a first cooling temperature in the temperature range of 500 to 600° C. at an average cooling rate of 1.0 to 12° C./sec.; and thereafter cooling the steel sheet from the first cooling temperature to room temperature at an average cooling rate of not more than 5° C./sec.

5. The method for producing a high strength cold rolled steel sheet with high yield ratio according to claim 4, wherein the cooling of the hot rolled steel sheet is performed in such a manner that the cooling is started within 1 second after the completion of finish rolling, and the steel sheet is cooled to a cooling end temperature in the temperature range of 650 to 750° C. at an average cooling rate of not less than 20° C./sec. and is air-cooled from the cooling end temperature to 600° C. in a cooling time of not less than 5 seconds.

6. The method for producing a high strength cold rolled steel sheet with high yield ratio according to claim 5, wherein the steel slab further includes, by mass %, at least one element selected from the group consisting of V: not more than 0.10%, Ti: not more than 0.10%, Nb: not more than 0.10%, Cr: not more than 0.50%, Mo: not more than 0.50%, Cu: not more than 0.50%, Ni: not more than 0.50% and B: not more than 0.0030%.

7. The method for producing a high strength cold rolled steel sheet with high yield ratio according to claim 4, wherein the steel slab further includes, by mass %, at least one element selected from the group consisting of V: not more than 0.10%, Ti: not more than 0.10%, Nb: not more than 0.10%, Cr: not more than 0.50%, Mo: not more than 0.50%, Cu: not more than 0.50%, Ni: not more than 0.50% and B: not more than 0.0030%.

* * * * *